US009293810B2

(12) United States Patent
Darden, IV et al.

(10) Patent No.: US 9,293,810 B2
(45) Date of Patent: Mar. 22, 2016

(54) ANTENNA FOR A WEARABLE DEVICE

(71) Applicant: Filip Technologies UK Ltd., London (GB)

(72) Inventors: William H Darden, IV, Cary, NC (US); Kenneth Hogue, Chapel Hill, NC (US); Anders Broms, Nacka (SE); Owen Lewis Joyce, Cary, NC (US); Jeffrey Lick, Raleigh, NC (US); Paal Selnaes, Morrisville, NC (US)

(73) Assignee: Filip Technologies UK Ltd., London (GB)

( * ) Notice: Subject to any disclaimer, the term of this patent is extended or adjusted under 35 U.S.C. 154(b) by 85 days.

(21) Appl. No.: 14/011,352

(22) Filed: Aug. 27, 2013

(65) Prior Publication Data

US 2014/0191912 A1 Jul. 10, 2014

Related U.S. Application Data

(63) Continuation-in-part of application No. PCT/US2013/020326, filed on Jan. 4, 2013.

(51) Int. Cl.

| | |
|---|---|
| ***H01Q 1/12*** | (2006.01) |
| ***H01Q 1/27*** | (2006.01) |
| *H01Q 1/38* | (2006.01) |
| *H01Q 9/42* | (2006.01) |
| *H01Q 5/371* | (2015.01) |

(52) U.S. Cl.

CPC ..... *H01Q 1/273* (2013.01); *H01Q 1/38* (2013.01); *H01Q 5/371* (2015.01); *H01Q 9/42* (2013.01)

(58) Field of Classification Search

CPC ..... H01Q 1/273
USPC ..... 343/718
See application file for complete search history.

(56) References Cited

U.S. PATENT DOCUMENTS

| | | | | |
|---|---|---|---|---|
| 2005/0054321 | A1 | 3/2005 | Casagrande et al. | 343/718 |
| 2010/0026587 | A1 | 2/2010 | Wang et al. | 343/702 |
| 2011/0012788 | A1 * | 1/2011 | Rowell et al. | 343/700 MS |
| 2012/0056792 | A1 * | 3/2012 | Han | 343/718 |
| 2012/0092822 | A1 | 4/2012 | Mooring et al. | 361/679.21 |
| 2012/0111950 | A1 * | 5/2012 | Worrall et al. | 235/488 |

FOREIGN PATENT DOCUMENTS

WO WO 2015/031249 3/2015

OTHER PUBLICATIONS

International Search Report and Written Opinion issued Dec. 5, 2015 by the International Searching Authority for Application No. PCT/US2014/052513, which was filed Aug. 25, 2014 and published as WO/2015/031249 on Mar. 5, 2015 (Inventor—William H. Darden, et al. // Applicant—Filip Technologies UK Ltd.) (7 Pages).

* cited by examiner

*Primary Examiner* — Dameon E Levi
*Assistant Examiner* — Collin Dawkins
(74) *Attorney, Agent, or Firm* — Ballard Spahr LLP

(57) ABSTRACT

This disclosure relates to antennas for wearable devices. In an aspect, the antenna includes an active portion that includes conductive traces that send and receive radiofrequency communication signals. The antenna also includes a ground plane. The antenna includes a spacer that provides separation between the active portion and the ground plane portion.

17 Claims, 4 Drawing Sheets

ANTENNA FOR A WEARABLE DEVICE

CROSS-REFERENCE TO RELATED APPLICATIONS

This application is a continuation-in-part of International Patent Application No. PCT/US2013/020326, the disclosure of which is incorporated by reference herein.

BACKGROUND

Devices capable of wireless communication have become pervasive in society. "Smart" portable devices such as smartphones and tablet computers are nearly ubiquitous. These devices are typically able to connect to wireless networks using a variety of radiofrequency standards, such as Wi-Fi, cellular, and Bluetooth.

There have been attempts to develop wearable devices that can offer much of the utility of these smart devices in a package that can be worn on the body. Such attempts have fallen short of the connectivity and performance that purchasers seek. Accordingly, there is a need in the art for a wearable wireless device that provides this desired performance and connectivity.

SUMMARY

It is to be understood that both the following general description and the following detailed description are exemplary and explanatory only and are not restrictive, as claimed. Provided is an antenna for a wearable device.

In one aspect, an antenna for a wearable device is described. The antenna can include an active portion that can include conductive traces that can send and receive radiofrequency communication signals. The antenna can also include a ground plane portion. The antenna can also include a spacer between the active portion and the ground plane portion. The spacer can provide separation between the active portion and the ground plane portion. The antenna can be a flexible printed circuit.

The spacer can be made from a dielectric material. The spacer can also include a cavity that can be filled with air. The spacer can have an inside surface that is generally disposed toward a body. The spacer can also have an outside surface that is generally disposed away from a body. The active portion of the antenna can be generally disposed on the outside surface of the spacer. The ground plane portion can be substantially disposed on the inside surface of the spacer.

The wearable device can include a band that can be worn on a body. The band can include active portion, the ground plane portion, and the spacer. In an aspect, the wearable device can be worn on a wrist.

In another aspect, a wearable radiofrequency device is described. The wearable radiofrequency device can include a band that allows the device to be worn. The wearable device can be configured to be worn on a wrist. The band can include an antenna. The antenna can include an active portion that includes conductive traces that are configured to send and receive radiofrequency communication signals. The antenna can also include a ground plane portion. The antenna can also include a spacer between the active portion and the ground plane portion that provides separation between the active portion and the ground plane portion.

The spacer can include an inside surface and an outside surface. The inside surface can be disposed toward a body. The outside surface can be disposed away from a body. The antenna can be mounted on the spacer such that the active portion is substantially disposed on the outside surface of the spacer and the around plane portion is substantially disposed on the inside surface of the spacer. The spacer can be made from a dielectric material. The spacer can also include a cavity. The cavity can include air.

In yet another aspect, an antenna assembly for a wearable radiofrequency device is described. The antenna assembly can include a flexible printed circuit antenna. The flexible printed circuit antenna can include an active portion that can include conductive traces that are configured to send and receive radiofrequency communication signals. The flexible printed circuit antenna can also include a ground plane portion.

The antenna assembly can also include a spacer that provides separation between the active portion and the ground plane portion. The spacer can include an inside surface that can be disposed toward a body when the wearable device is worn. The spacer can also include an outside surface that can be disposed away from a body when the wearable device is worn. The spacer can be made from a dielectric material. The flexible printed circuit antenna can be coupled to the spacer such that the active portion is substantially disposed on the outside surface and the ground plane portion is substantially disposed on the inside surface.

The antenna assembly can include a band that can be worn around a portion of a body. The band can be configured to be worn around a wrist.

Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the apparatus.

DETAILED DESCRIPTION

Before the present apparatus is disclosed and described, it is to be understood that the claimed apparatus is not limited to specific components, configurations, or to particular implementations described herein. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the distribution points of each of the ranges are significant both in relation to the other distribution point, and independently of the other distribution point.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to make the described apparatus. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all apparatuses. This applies to all aspects of this application.

The present apparatus may be understood more readily by reference to the following detailed description of preferred embodiments and the examples included therein and to the Figures and their previous and following description.

Figure 1:
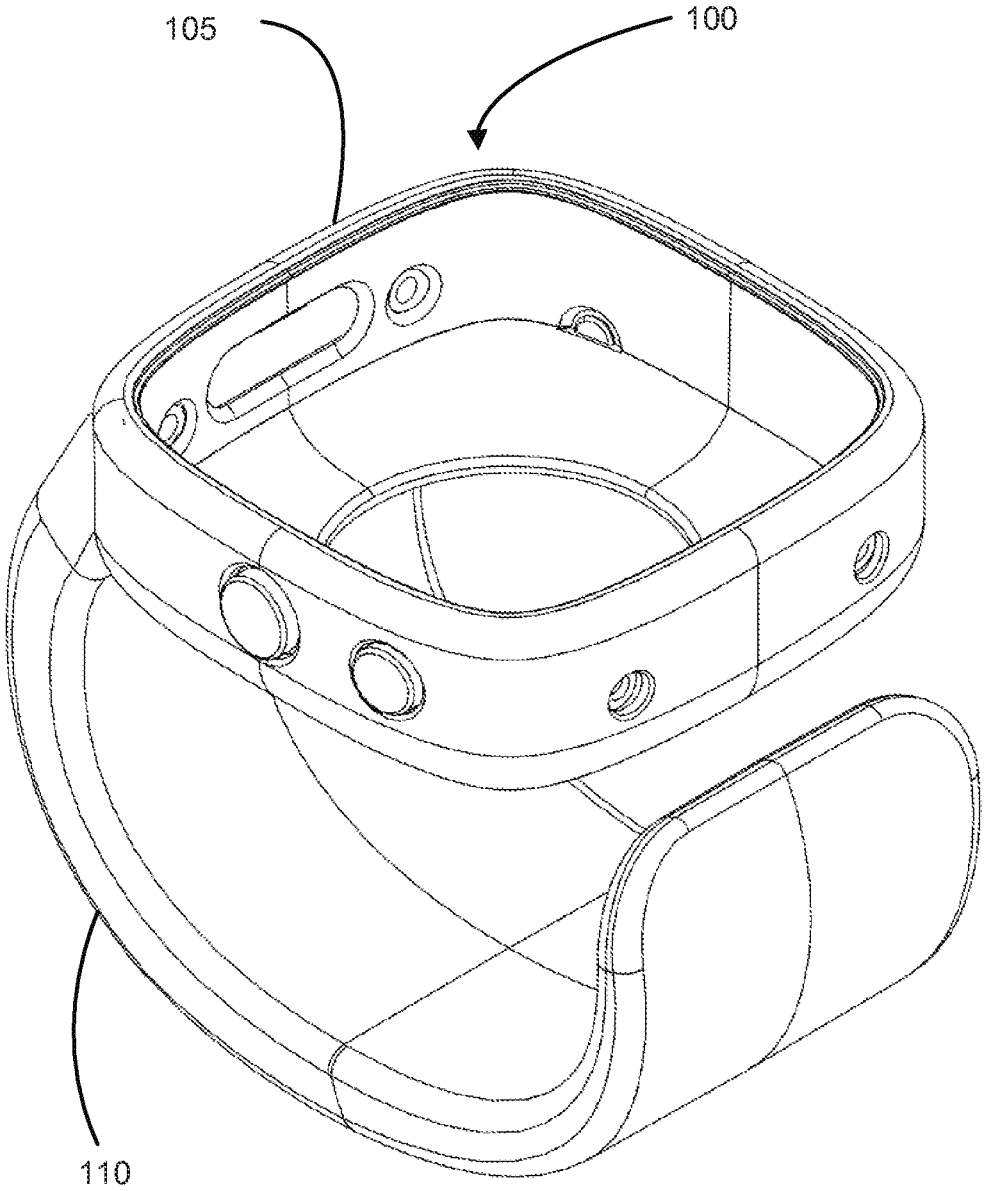
FIG. 1 is a perspective view of a wearable device in accordance with an exemplary embodiment of the apparatus described herein.

Turning now to FIG. 1, a perspective view of a wearable device in accordance with an exemplary embodiment of the apparatus described herein is shown. In an exemplary embodiment, the wearable device 100 is a wrist-borne device. In alternative exemplary embodiments, the apparatus may be worn on other areas of the body, such as the ankle, waist, neck, or around other parts of the legs and/or torso. As one of skill in the art would understand, modifying the wearable device 100 to fit various parts of the body involves modifying the size and configuration of the band 110 so as to be the appropriate size and have the appropriate rigidity for a given application. Such modifications are within the scope of the present disclosure.

The wearable device 100 includes a band 110 and a housing 105. The band 110 can be made from a suitable material and configured such that it can hold the wearable device 100 in place on the wrist. By way of example, the band 110 can be made from a thermoplastic elastomer (TPE). In alternative exemplary embodiments, the band 110 can be made from other suitable materials, such as, but not limited to, cloth, canvas, rubber, or silicone. The band 110 in the exemplary embodiment can be configured as a solid, moderately flexible band that is approximately C-shaped as shown in FIG. 1, however, alternative configurations of the band 110 are contemplated in this disclosure. For example, the band 110 can form a complete loop so long as the loop is either sufficiently flexible or detachable so as to be able to be put in place on the wrist. International Patent Application No. PCT/US2013/020326, which is incorporated by reference in its entirety, describes one such alternative configuration for the band 110. In accordance with an exemplary embodiment, the band 110 is also configured to contain an antenna. The configuration of the antenna within the band 110 will be discussed in greater detail with respect to FIGS. 2-4.

The band 110 is coupled to a housing 105. The housing 105 is configured to hold a communication device. By way of example, the communication device can be a device such as the device disclosed in International Patent Application No. PCT/US2013/020326. In an alternative exemplary embodiment, however, the communication device can be any type of communication device, such as a miniaturized smartphone, fitness monitor, pedometer, GPS device, biometric sensor, or any other device that can take advantage of the antenna in the band 110. The size and shape of the housing 105 shown in FIG. 1 is for illustrative purposes only and may be modified so as to suitably hold the chosen device.

Figure 2:
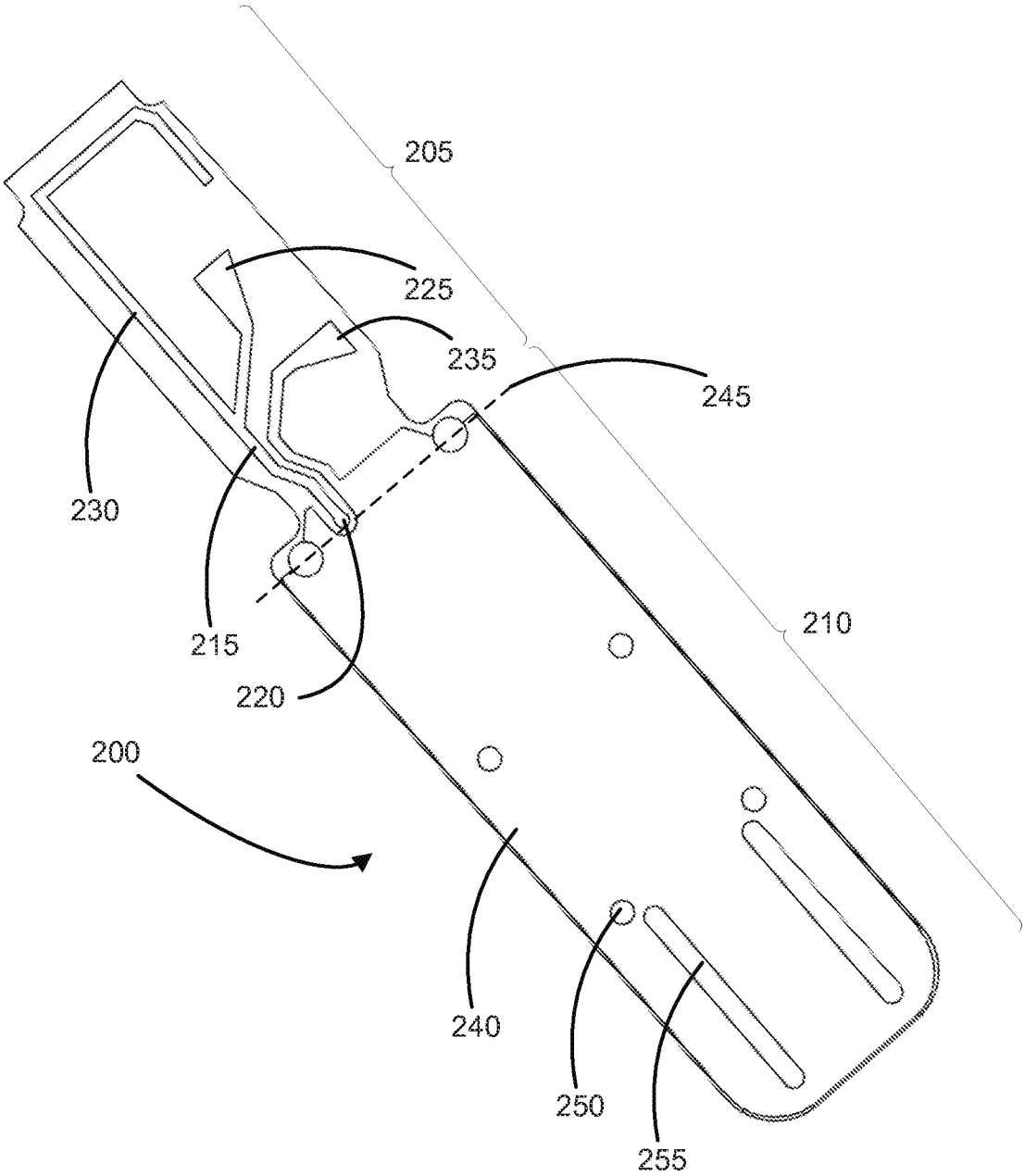
FIG. 2 is a diagram of an antenna in accordance with an exemplary embodiment of the apparatus described herein.

Turning now to FIG. 2, an antenna 200 in accordance with an exemplary embodiment of the present invention is shown. The exemplary antenna 200 is configured to fit within the band 110 of the device, such that the band 110 completely envelopes at least the conductive portions of the antenna 200. In alternative exemplary embodiments, certain conductive portions of the antenna 200 may be external to the band 110.

In the exemplary embodiment, the antenna 200 is a flexible printed circuit (FPC). In alternative exemplary embodiments, the antenna 200 can be formed from stamped metal, plating over plastic, or other antenna creation techniques. The antenna 200 can include an active portion 205 that includes the radiating portions of the antenna 200. The antenna 200 can also include a ground plane portion 210 that contains a ground plane 240.

The active portion 205 of the exemplary antenna 200 can include conductive traces consistent with the wireless application for which the antenna 200 is to be used. By way of example, the antenna 200 shown in FIG. 2 is designed to operate on a GSM (Global System for Mobile Communications) network in the United States. The exemplary antenna 200 shown in FIG. 2 includes a first trace 215 that is connected to the transmitter and receiver. The first trace 215 emanates from a connection point 220 and splits into two portions. The first branch 225 of the first trace 215 splits off with a trace that is approximately as wide as the first trace 215, and then ends in a trapezoidal trace. The second branch 230 of the first trace 215 remains approximately the same width as the first trace 215 and extends much of the length of the top portion of the antenna 200. The second branch 230 then turns and runs substantially parallel to the top of the antenna 200. The second branch 230 then turns again and runs substantially parallel with the side of the antenna 200. In the exemplary embodiment, the first trace 215 is electrically isolated from the second trace and the ground plane 240.

The exemplary antenna 200 includes a parasitic trace 235 that is electrically coupled to a ground plane 240. The exemplary parasitic trace 235 extends upward from the ground plane 240 and turns away from the first trace 215. The parasitic trace 235 then expands and terminates in a trapezoidal shape.

The ground plane portion 210 of the exemplary antenna 200 can include a ground plane 240. The ground plane 240 is coupled to a ground line from the communication device (not shown). The antenna 200 can be configured so that it is bendable, and so that it can be folded along a fold line 245 that generally distinguishes the ground plane portion 210 of the antenna 200 from the radiating portion of the antenna 200. The antenna 200 is also configured with several notches 255 and holes 250 that can be used to align the antenna 200 when mounting it in the wearable device 100.

At the time of this application filing, GSM networks in the United States operate in frequency ranges from 824-849 MHz, 869-864 MHz, 1,850-1,910 MHz, and 1,930-1,990 MHz. However, one of skill in the art would understand that other types of wireless networks (such as CDMA networks), and networks in other countries, operate at different frequencies. One of ordinary skill in the art would be able to modify the conductive traces shown in the antenna 200 in FIG. 2 to optimize antenna 200 performance for networks that operate at different frequencies.

Figure 3:
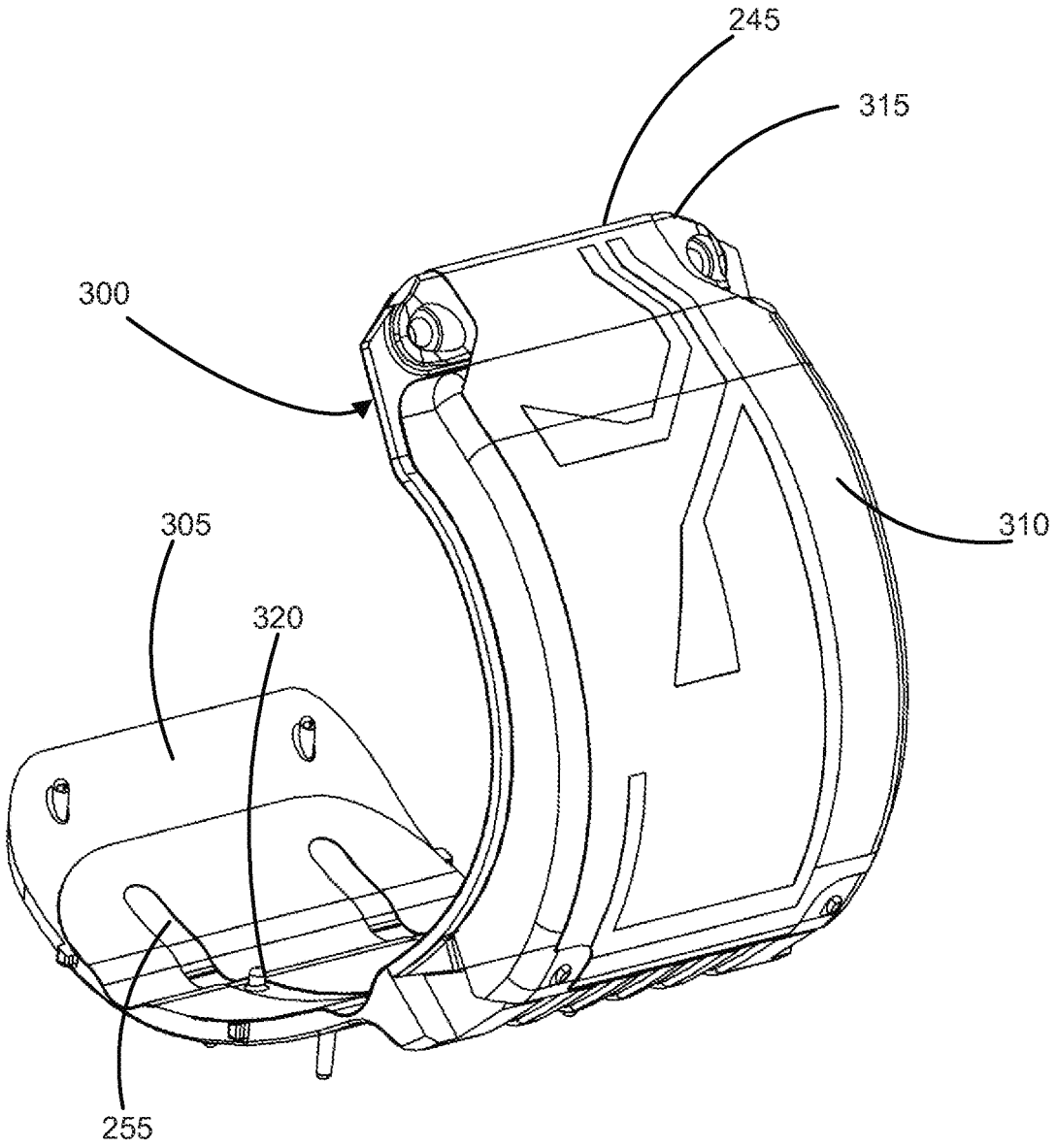
FIG. 3 is a perspective view of an antenna and antenna support in accordance with an exemplary embodiment of the apparatus described herein.

Turning now to FIG. 3, the exemplary antenna 200 described in FIG. 2 is shown installed on an exemplary band core 300. In an exemplary embodiment, the antenna 200 would be mounted on the band core 300, although in alternative exemplary embodiments, the conductive portions of the antenna can be stamped directly onto the band core. This assembly would then be inside the band 110 (described with respect to FIG. 1). The band core 300, in conjunction with the antenna 200, provides certain functional advantages with respect to the wearable device 100. For example, the core can provide rigidity that can support the antenna 200. In addition, the core provides spacing between the ground plane 240 and the active portion 205. This spacing both reduces the heat generated by the antenna 200, and improves the antenna's 200 performance. In an exemplary embodiment, the core also includes posts 320 that can be inserted into holes in the antenna 200 so as to align the antenna 200 with the core.

In an exemplary embodiment, the ground plane 240 is located on the inside surface 305 of the core (body side of the band 110) while the active portion 205 of the antenna 200 is located on the outside surface 310 of the core (non-body side of the band 110). The fold line 245 is aligned with the top portion 315 of the core that marks the transition between the inside and the outside. This exemplary configuration, in combination with the spacing provided by the core, directs the antenna's 200 radiation pattern away from the body, while still providing sufficient performance to be able to allow the communication device to operate in conjunction with wireless networks.

Orienting the ground plane portion 210 and the active portion 205 of the antenna 200 as described herein also allows for the use of a larger ground plane 240 with respect to the active portion 205 of the antenna 200. Conventional ground planes can generate a significant amount of heat, which, in some applications, is not a problem. However, in the context of a wearable device 100, generating a significant amount of heat in a ground plane that is worn close to the body is not desirable, and may even be dangerous. A larger ground plane has improved ability to dissipate current generated in the ground plane by radiation from the active portion 205 of the antenna 200, and therefore the larger ground plane 240 generates less heat. Further, because of the increased surface area, any heat generated is dissipated more quickly, and over a greater area, further reducing the amount of heat available to be transferred to the wearer of the device. Because the disclosed embodiments allow for the use of a larger ground plane 240 less heat is generated in the ground plane 240, thus improving the performance of the antenna 200 for use in a wearable device 100.

Figure 4:
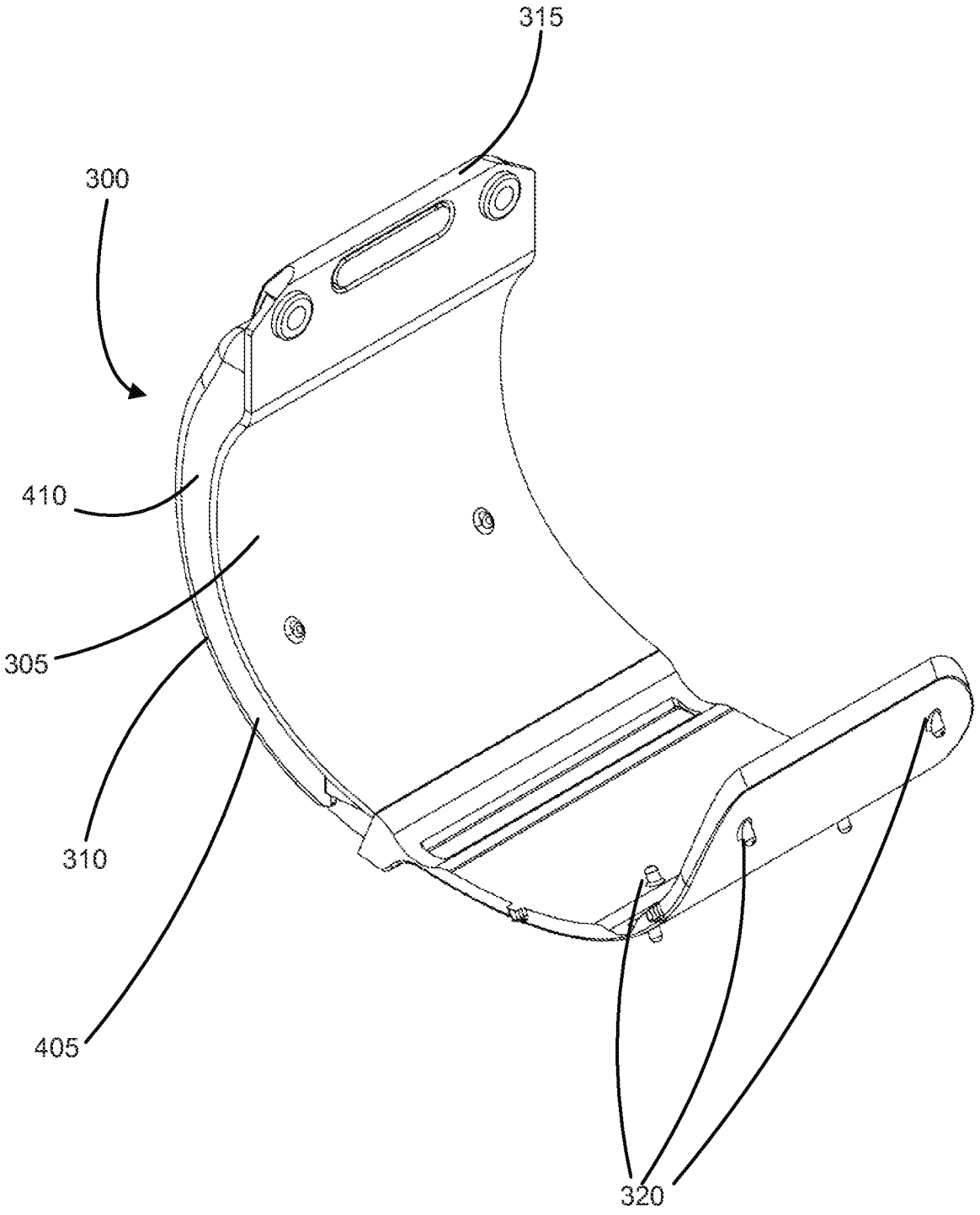
FIG. 4 is a perspective view of an antenna support in accordance with an exemplary embodiment of the apparatus described herein.

Turning now to FIG. 4, a perspective view of an exemplary embodiment of the band core 300 is shown. FIG. 4 provides an additional view of the top portion 315, inside surface 305, outside surface 310, and posts 320 for the exemplary embodiment, as set forth in FIG. 3. The exemplary embodiment of the band core 300 can also include a spacer 405 that provides separation between the active portion 205 of the antenna 200 and the ground plane portion 210. The spacer 405 can also provide additional structural support to the band 110. Because the spacer 405 provides insulation between the radiation emanating from the active portion 205 of the antenna 200 and the ground plane 240. This separation further reduces the amount of heat generated in the ground plane 240, as discussed above.

In an exemplary embodiment, the spacer 405 is made from injection-molded plastic, although in alternative exemplary embodiments, the spacer 405 may be made from any material having dielectric properties. The exemplary spacer 405 forms a cavity 410 between the inside surface 305 and the outside surface 310, and in the exemplary embodiment, that cavity 410 can be filled with air, although in alternative embodiments the cavity 410 may be filled with any material that is not detrimental to the performance of the antenna 200. The cavity 410 may also be a solid piece made from the same material as the band core 300.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. An antenna for a wearable device, comprising:

an active portion comprising conductive traces configured to send and receive radiofrequency communication signals;

a ground plane portion;

the active portion disposed on a first portion of a flexible printed circuit;

the ground plane portion disposed on a second portion of the flexible printed circuit; and a spacer configured to provide separation between the active portion and the ground plane portion, wherein the flexible printed circuit is disposed around an edge of the spacer such that the active portion is disposed on an outside surface of the spacer, and the ground plane portion is disposed on an inside surface of the spacer.

2. The antenna of claim 1, wherein the spacer is comprised of a dielectric material.

3. The antenna of claim 1, wherein the spacer comprises a cavity.

4. The antenna of claim 3, wherein the cavity comprises air.

5. The antenna of claim 1, wherein the inside surface of the spacer is disposed toward a body, and the outside surface of the spacer is disposed away from a body.

6. The antenna of claim 1, wherein the wearable device is configured to be worn on a wrist.

7. The antenna of claim 1, further comprising a band configured to be worn on the body, the band further comprising the active portion, the ground plane portion, and the spacer.

8. A wearable radiofrequency device, comprising:

a band configured to allow the device to be worn, the band comprising an antenna, the antenna further comprising:

an active portion comprising conductive traces configured to send and receive radiofrequency communication signals;

a ground plane portion;

the active portion disposed on a first portion of a flexible printed circuit;

the ground plane portion disposed on a second portion of the flexible printed circuit; and a spacer between the active portion and the ground plane portion, the spacer configured to provide separation between the active portion and the ground plane portion, wherein the flexible printed circuit disposed around an edge of the spacer such that the active portion is disposed on an outside surface of the spacer, and the ground plane portion is disposed on an inside surface of the spacer.

9. The wearable radiofrequency device of claim 8, wherein the spacer comprises a dielectric material.

10. The wearable radiofrequency device of claim 8, wherein the spacer comprises a cavity.

11. The wearable radiofrequency device of claim 10, wherein the cavity comprises air.

12. The wearable radiofrequency device of claim 8, wherein the inside surface of the spacer is disposed toward a body, and the outside surface of the spacer is disposed away from a body.

13. The wearable radiofrequency device of claim 8, wherein the wearable device is configured to be worn on a wrist.

14. An antenna assembly for a wearable radiofrequency device, comprising:

an antenna comprising:

an active portion comprising conductive traces configured to send and receive radiofrequency communication signals; and a ground plane portion, the active portion and the ground plane portion disposed on a single flexible printed circuit;

a spacer configured to provide separation between the active portion and the ground plane portion, the spacer comprising:

an inside surface configured to be disposed toward a body w the wearable device is worn; and an outside surface configured to be disposed away from a body when the wearable device is worn;

the antenna disposed around an edge of the spacer such that the active portion is substantially disposed on the outside surface, and the ground plane portion is substantially disposed on the inside surface.

15. The antenna assembly of claim 14, further comprising a band configured to be worn around a portion of a body.

16. The antenna assembly of claim 15, wherein the band is configured to be worn around the wrist.

17. The antenna assembly of claim 14, wherein the spacer comprises a dielectric material.

* * * * *